US009656111B1

(12) United States Patent
Biddle

(10) Patent No.: US 9,656,111 B1
(45) Date of Patent: May 23, 2017

(54) CLIMBING WALL CONFIGURATION SYSTEMS AND METHODS

(71) Applicant: TradLabs, Inc., Seattle, WA (US)

(72) Inventor: Peter N. Biddle, Seattle, WA (US)

(73) Assignee: TradLabs, Inc., Seattle, WA (US)

( * ) Notice: Subject to any disclaimer, the term of this patent is extended or adjusted under 35 U.S.C. 154(b) by 0 days.

(21) Appl. No.: 14/945,268

(22) Filed: Nov. 18, 2015

(51) Int. Cl.

| | |
|---|---|
| ***A63B 9/00*** | (2006.01) |
| ***A63B 17/04*** | (2006.01) |
| ***A63B 17/02*** | (2006.01) |
| ***A63B 71/02*** | (2006.01) |

(52) U.S. Cl.
CPC ..... *A63B 17/04* (2013.01); *A63B 9/00* (2013.01); *A63B 17/02* (2013.01); *A63B 71/023* (2013.01)

(58) Field of Classification Search
CPC ..... A63B 69/0048; A63B 29/00
USPC ..... 248/925; 482/37
See application file for complete search history.

(56) References Cited

U.S. PATENT DOCUMENTS

| | | | | |
|---|---|---|---|---|
| 5,484,132 | A | 1/1996 | George | |
| 6,514,178 | B2 * | 2/2003 | Vettori | A63B 69/0048 482/35 |
| 7,520,838 | B1 * | 4/2009 | Sudeith | A63B 69/0048 482/35 |
| 7,524,269 | B2 * | 4/2009 | Postma | A63B 69/0048 482/37 |
| 7,563,202 | B1 * | 7/2009 | Sudeith | A63B 69/0048 482/37 |
| 7,611,444 | B1 * | 11/2009 | Sudeith | A63B 69/0048 482/37 |
| 7,963,368 | B2 | 6/2011 | Scudera | |
| 8,038,581 | B1 * | 10/2011 | Sudeith | A63B 69/0048 482/37 |
| 2003/0006351 | A1 | 1/2003 | Murray | |
| 2003/0013579 | A1 | 1/2003 | Rennex | |
| 2004/0162190 | A1 * | 8/2004 | Diamond | A63B 69/0048 482/37 |
| 2005/0245355 | A1 * | 11/2005 | Brewer | A63B 69/0048 482/37 |
| 2006/0192066 | A1 * | 8/2006 | Mills | A63B 69/0048 248/314 |
| 2008/0300111 | A1 * | 12/2008 | Meissner | A63B 69/0048 482/36 |
| 2010/0016126 | A1 * | 1/2010 | Wu | A63B 69/0048 482/37 |
| 2010/0181142 | A1 | 7/2010 | Gerner | |
| 2011/0201435 | A1 * | 8/2011 | Stromberg | A63B 69/0048 472/116 |
| 2011/0319230 | A1 | 12/2011 | Brendle | |
| 2013/0184124 | A1 * | 7/2013 | Reed | A63B 69/0048 482/37 |
| 2013/0337979 | A1 * | 12/2013 | Coste | A63B 69/0048 482/35 |
| 2014/0106938 | A1 * | 4/2014 | Sudeith | A63B 69/0048 482/37 |

(Continued)

OTHER PUBLICATIONS

Luebben: "Rock Climbing Anchors: A Comprehensive Guide", book, 2007, 1st Edition, The Mountaineers Books, Seattle WA, U.S.

*Primary Examiner* — Bradley Duckworth
(74) *Attorney, Agent, or Firm* — AEON Law, PLLC; Adam L. K. Philipp; Jonathan E. Olson

(57) ABSTRACT

Climbing wall configuration systems and methods suitable for use with both traditional protection and a primary substructure of a climbing wall.

20 Claims, 14 Drawing Sheets

(56) References Cited

U.S. PATENT DOCUMENTS

| | | | | |
|---|---|---|---|---|
| 2014/0323274 | A1* | 10/2014 | Moy | A63B 69/0048 482/37 |
| 2015/0056590 | A1 | 2/2015 | Brost | |
| 2015/0099613 | A1* | 4/2015 | Munoz Saez | A63B 21/16 482/139 |
| 2015/0343288 | A1* | 12/2015 | Taggart | A63B 69/0048 482/37 |
| 2016/0136496 | A1* | 5/2016 | Garnier | H05B 37/0272 315/76 |

* cited by examiner

CLIMBING WALL CONFIGURATION SYSTEMS AND METHODS

FIELD

This disclosure relates to configuring holds or other climbing wall protrusions for use with traditional protection.

BACKGROUND

Modern rock climbing involves the use of holds by climbers to scale a real or artificial rock face with crash pads, anchors and a rope, all of which reduce the inherent risks involved in falling. Holds exist in nature in the rock itself and in rock climbing gyms through a combination of handholds and foot holds built into walls themselves as well as individual climbing holds which are frequently attached to climbing walls via bolts or screws. While climbing walls are generally made out of wood or plastic panels, frequently with textured coatings, the holds are frequently cast out of a urethane-based polymer.

Climbers reduce their risks in climbing via either ground-based pads (as in the case of bouldering, where heights are generally under 20 feet) or with a combination of anchors and rope. Ropes may be secured to the climbers via knots and carabiners and to the walls (indoors or outdoors) using one or more anchors (anchors are also known as "protection" within rock climbing communities). These anchors are secured to a foundation, which may comprise climbing walls, solid rock, large boulders, trees, ice, or even snow. The anchors themselves divide rope-based climbing into two general categories: sport and traditional climbing.

Sport climbing uses bolted anchors, which are semi-permanently attached to the rock via holes drilled into the rock face. Climbers on a sport route do not have to set anchors while they are climbing because the anchors on a sport climbing route were previously set, in some cases months or even years before. Sport climbing is available both outdoors and in rock-climbing gyms, where the anchors are drilled into the wood or plastic panels.

Traditional climbing uses mechanical anchors to establish temporary protection from falling. These anchors may be wedged into gaps in the rock face and they have many descriptive and trade names, including cams, hexes and wire nuts. The anchors that are set into the wall this way must be removed by a second climber following the first—the lead climber sets the protection anchors while the following climber takes them out as she goes. Setting protection anchors is referred to as lead climbing while taking out protection anchors is referred to as cleaning protection. While man-made rock climbing walls currently support a wide variety of climbing, they are generally unable to support the setting of traditional climbing anchors because neither the holds themselves nor the walls are designed to support the forces involved in arresting a fall by a climber connected to the wall via a mechanical anchor.

Because of the inability to set traditional protection anchors on rock climbing gym walls, nearly all climbing in rock climbing gyms is limited to bouldering or sport climbing, making the transition from the rock climbing gym and sport climbing to outdoor traditional climbing challenging. There simply is no cost-effective way to actively learn and practice traditional rock climbing protection-setting techniques in a rock climbing gym setting.

Some complete rock climbing walls may be built out of solid rock or a rock-like substance such as concrete, which in theory could be used to teach climbers how to set protection in a gym, however in practice these walls will not allow a gym to dynamically add or re-position spots where climbers can set anchors. Rock-climbing gym walls themselves are generally static and immovable.

One early attempt to allow for traditional climbing protection on a climbing wall is presented in U.S. Pub. No. 2015/0056590 ("Apparatus and method for traditional rock climbing training"). That disclosure presented a unitary climbing anchor for attaching to a climbing wall and adapted to engage a piece of traditional protection. It had a frame with a hole adapted to receive a bolt for holding the climbing anchor to a climbing wall and a tongue including a tether hole and protruding from the frame. Such crude climbing anchors have a narrow usefulness and, like other minor departures from the prevalent culture of indoor sport climbing, fail to provide for a climber falling in an unexpected manner.

DETAILED DESCRIPTION

Figure 1:
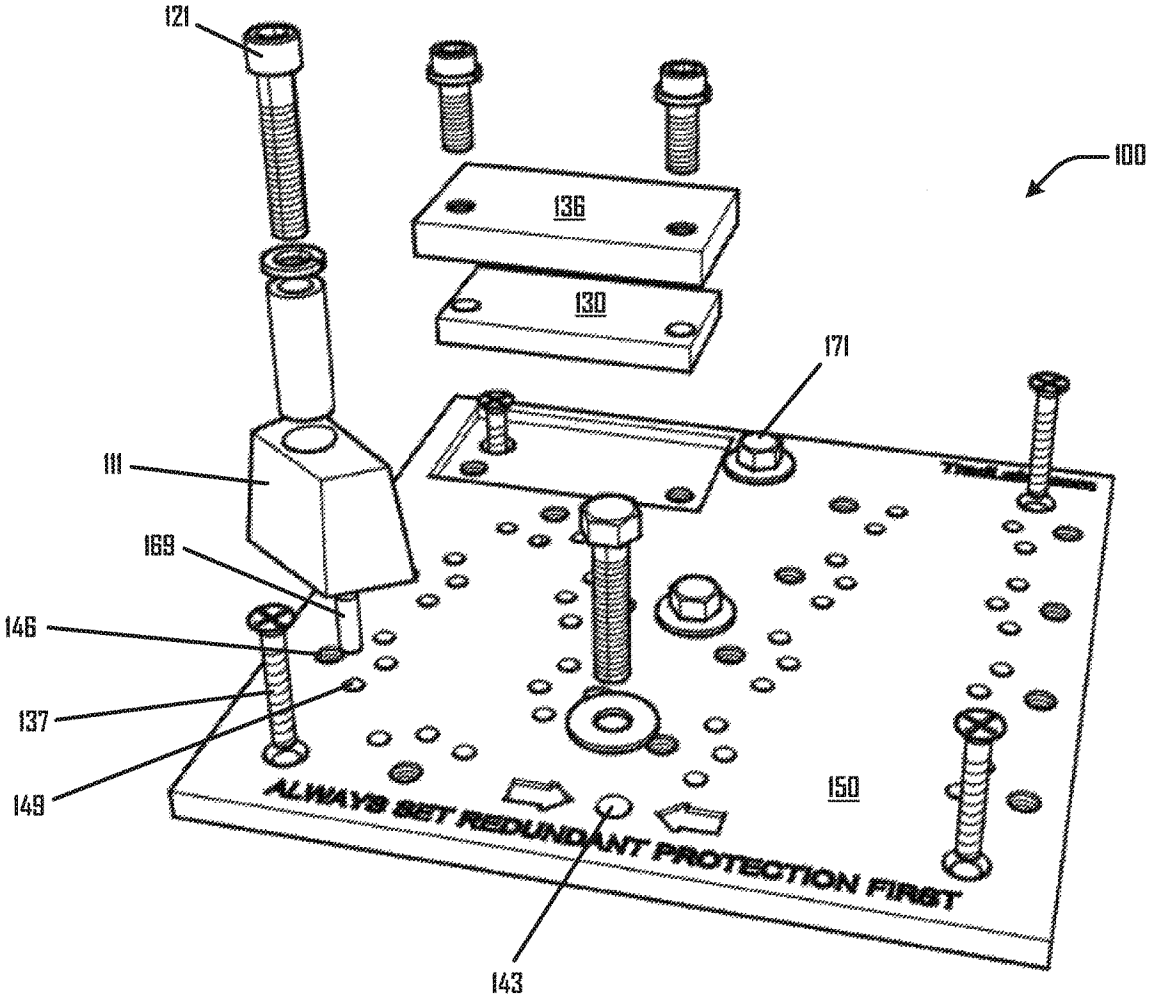
FIG. 1 illustrates an exploded view of a system that includes a partially assembled Prohold™ anchor-setting device.

As used herein, the phrases "in one embodiment," "in at least one embodiment," "in various embodiments," "in some embodiments," and the like may be used repeatedly. Such phrases do not necessarily refer to the same embodiment. The terms "comprising," "having," and "including" are synonymous open descriptors except where the context dictates otherwise. The detailed description that follows primarily comprises concisely described, select examples intended to facilitate rapid understanding of content herein that is not widely known.

Reference is now made in detail to the description of the embodiments as illustrated in the drawings. While embodiments are described in connection with the drawings and related descriptions, it will be appreciated by those of ordinary skill in the art that alternate and/or equivalent implementations may be substituted for the specific embodiments shown and described, including all alternatives, modifications, and equivalents, whether or not explicitly illustrated and/or described, without departing from the scope of the present disclosure. In various alternate embodiments, additional devices, or combinations of illustrated devices, may be added to, or combined, without limiting the scope to the embodiments disclosed herein.

FIG. 1 depicts an exploded view of a partially assembled Prohold™ anchor-setting device that may implement one or more technologies of the present invention. A climbing facilitation system 100 that includes the device includes one or more baseplates 150 each of which may directly support one or more rocks 111 each fastened to the baseplate with one or more bolts 121. A plurality of other bolts 171 is also provided for rigidly mounting baseplate 150 each through a respective hole 143 onto a load-bearing substructure, further described below. In some contexts, screws 137 may also be used for attaching the baseplate to non-structural elements (plaster or other veneers, e.g.) also described below. In some context a computer 130 protected by a cover 136 having one or more buttons or sensors (not shown) is also fastened to baseplate 150. When assembled, rock 111 will be held in place by bolt 121 engaging a threaded hole 146 in baseplate 150. Rock 111 also has a recess (in its underside, not shown) so that it can receive an anti-rotation pin 169, which also extends into a corresponding hole 149. A "bolt" as described herein has a nominal diameter of at least about ⅜" as contrasted with smaller threaded fasteners (screws 137, e.g.) that are adequate for resisting rotation in some configurations but not generally reliable enough for protecting a falling climber.

Figure 2:
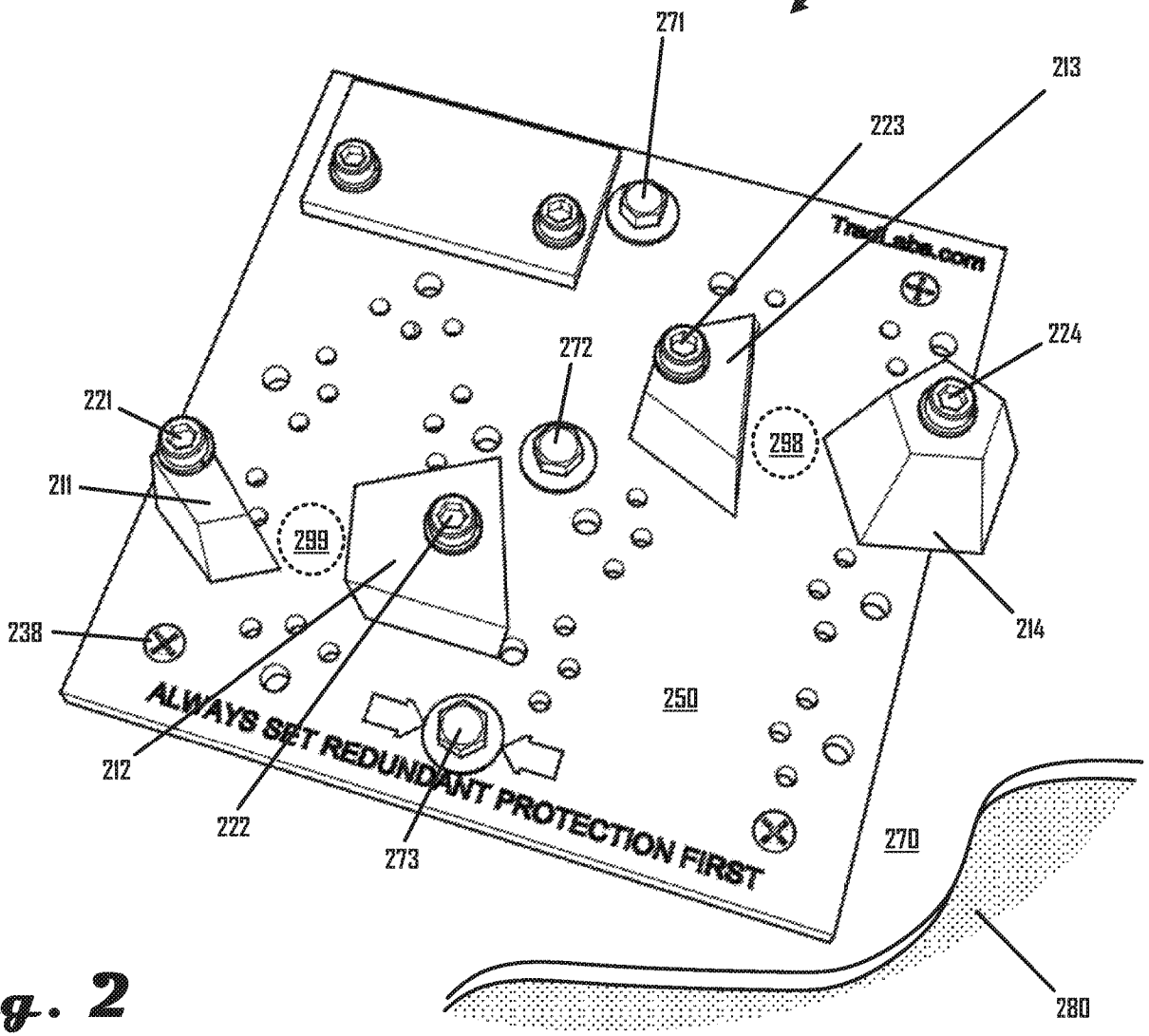
FIG. 2 illustrates a system that includes an assembled, installed view of a Prohold™ device, one that may (optionally) exemplify the system of FIG. 1.

FIG. 2 depicts an assembled, installed view of a system 200 that may exemplify system 100 in some variants. System 200 comprises one or more baseplates 250 each of which may directly support several rocks 211, 212, 213, 214 each fastened thereto with one or more corresponding bolts 221, 222, 223, 224. Several other bolts 271, 272, 273 rigidly mount baseplate 250 onto a girder or other load-bearing substructure 280. A relatively fragile veneer 270 may also be mounted onto the substructure 280 and/or to baseplate 250 (by one or more screws 238, e.g.). Two or more of the rocks 211, 212, 213, 214 fastened to baseplate 250 have gaps 298, 299 suitable for gripping various forms of "traditional" climbing protection therebetween: wired nuts, chocks, expandable tubes, tri-cams, slider nuts, active forms of protection (cams, e.g.). Such basic forms of generally exert a spreading force upon two or more protrusions (rocks 211-214, e.g.) mounted to baseplate. Each amount of force exerted upon a protrusion depends upon one or more angles of engagement (on each surface engaged by the protection, e.g.), the climber's weight and momentum, one or more angles of loading (downward or outward, e.g.), and many other such variables. These basic anchors may also be used in combinations to create redundant anchors, pre-equalized anchors, multi-directional anchors, or other such useful configurations (for training or competition purposes, e.g.) as further described below.

Figure 3:
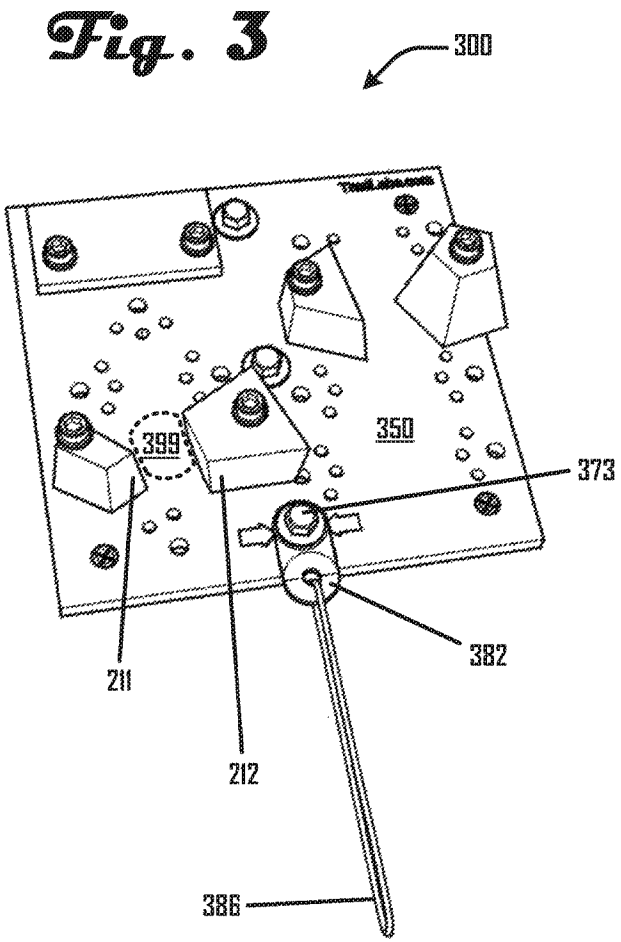
FIG. 3 illustrates a system in a context in which a redundant anchor secures a tether.

FIG. 3 depicts a system 300 that may also exemplify system 200 in a context in which a redundant anchor 382 secures a tether 386 to which a novice climber may be attached for safety while placing a primary anchor into gap 399. The redundant protection bolt 373 optionally goes all the way through the baseplate 350 and the wall and into any steel superstructure supporting the wall. This is a redundant protection to support the educational process of setting protection that is likely to fail regularly (because people are learning how to set it).

Figure 4:
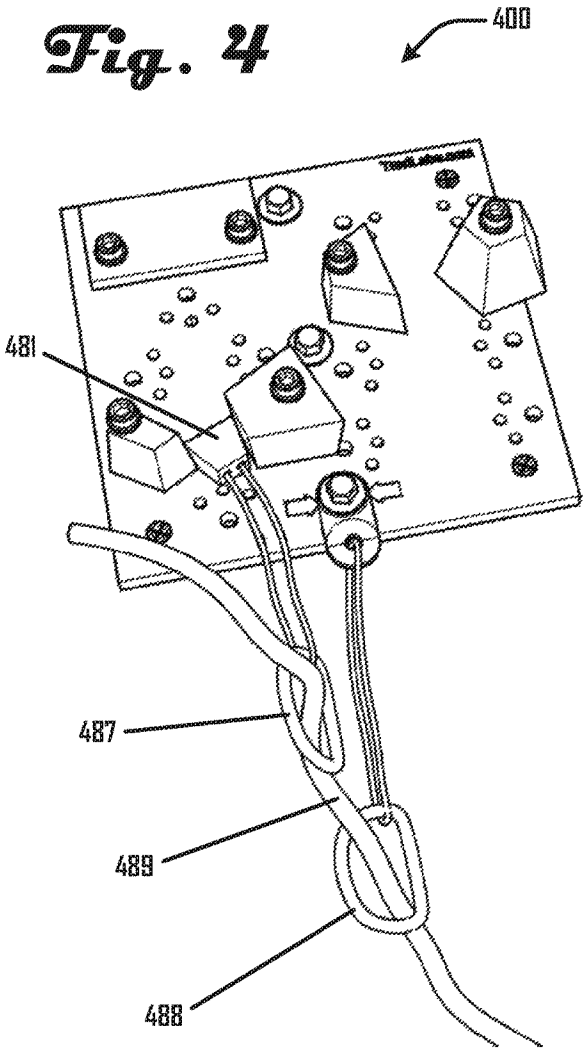
FIG. 4 illustrates a system in which a primary anchor has been installed into a gap between rocks.

FIG. 4 depicts a system 400 in which the primary anchor 481 (a wirenut, e.g.) has been installed into gap 399 as described above. Having just arrived into a vicinity of system 300, for example, a novice climber may first clip a caribiner 488 on his/her rope 489 onto the tether 386, then place the primary protection (anchor 481, e.g.), and then clip another caribiner 487 onto the same rope 489. If the novice climber then falls, typically the entire momentum of such movement (typically a combination of outward and downward movement, e.g.) will be suddenly opposed by anchor 481 exerting a spreading force shared by two rocks 211, 212 when the climber's rope 489 tightens. If the anchor 481 or its placement fails, it is then intended that the redundant anchor 382 will suddenly arrest the momentum the next time the same fall causes the rope 489 to tighten, saving the climber from serious injury.

Figure 5:
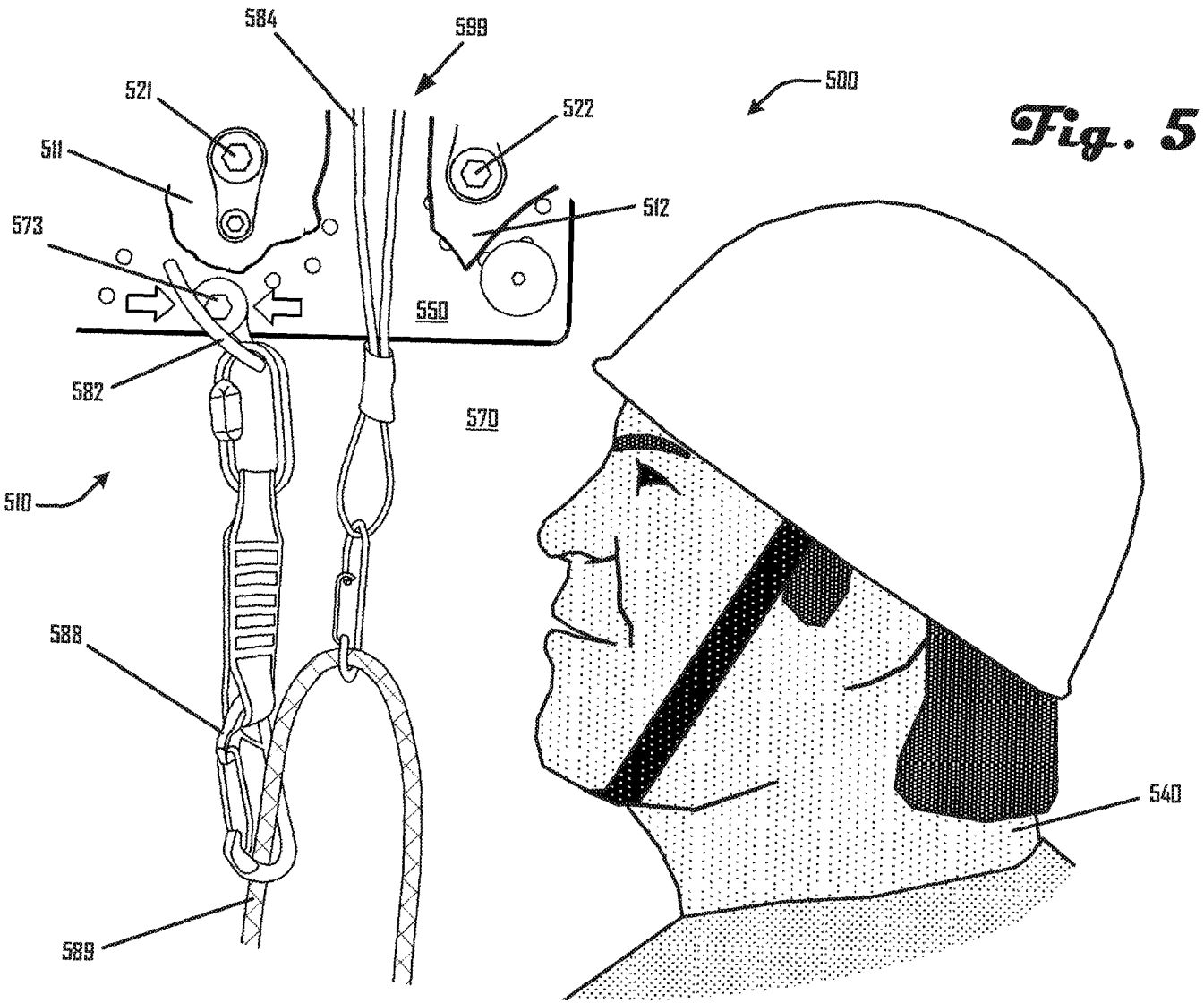
FIG. 5 illustrates a station at which a climber encounters a different Prohold™ anchor-setting device.

FIG. 5 depicts a protection-setting station 510 at which a climber 540 encounters a Prohold™ anchor-setting device. A climbing facilitation system 500 thereof (including baseplate 550, e.g.) is suitable for simultaneous use with both traditional protection 584 (a tethered tri-cam or expandable tube, e.g.) and one or more primary substructures of a climbing wall (load-bearing substructures to which a plurality of bolts 573 engage through a fragile veneer 570, e.g.). A "first" mountable protrusion (rock 511, e.g.) is configured to be supported at a reference position (as shown) and by one or more "first" rigid supports (bolt 521, e.g.) each engaging a corresponding bolt hole in a primary substructure (a load-bearing part of a building, e.g.). Likewise a "second" mountable protrusion (rock 512, e.g.) is configured to be mounted at a first position (as shown) relative to the reference position (where rock 511 is, e.g.) and by one or more "first" rigid supports (bolt 522, e.g.) each engaging a corresponding bolt hole in the primary substructure. This can occur, for example, in a context in which redundant protection has been set earlier (by climber 540 clipping a caribiner 588 supported by sport anchor 582 onto his rope 589, e.g.); in which rocks 511, 512 are configured to support compress and jointly support a first traditional protection anchor (protection 584 set in gap 599, e.g.) so that a first force transfer path (e.g. from protection 584 and through rocks 511, 512) is shared by a first plurality of rigid supports (e.g. bolts 521, 522) and passes entirely therethrough into the primary substructure; in which substructure 280 is covered by a climbing veneer 570 that is not strong enough to bear a substantial force pulse (of more than 5 kilonewtons, e.g.); and in which baseplate 550 would otherwise move (rotating about bolt 573 and thereby causing breakage of veneer 570, e.g.) in response to a falling climber force pulse (in which climber 540 reaching the end of rope 589 exerts a sudden force of 5 kN or more on protection 584, e.g.). Such veneer damage is likely, for example, in single-bolt configurations (like that depicted in U.S. Pub. No. 2015/0056590, e.g.)

when the climber falls in an unexpected manner (not directly away from the fulcrum of substructure engagement, e.g.).

Figure 6:
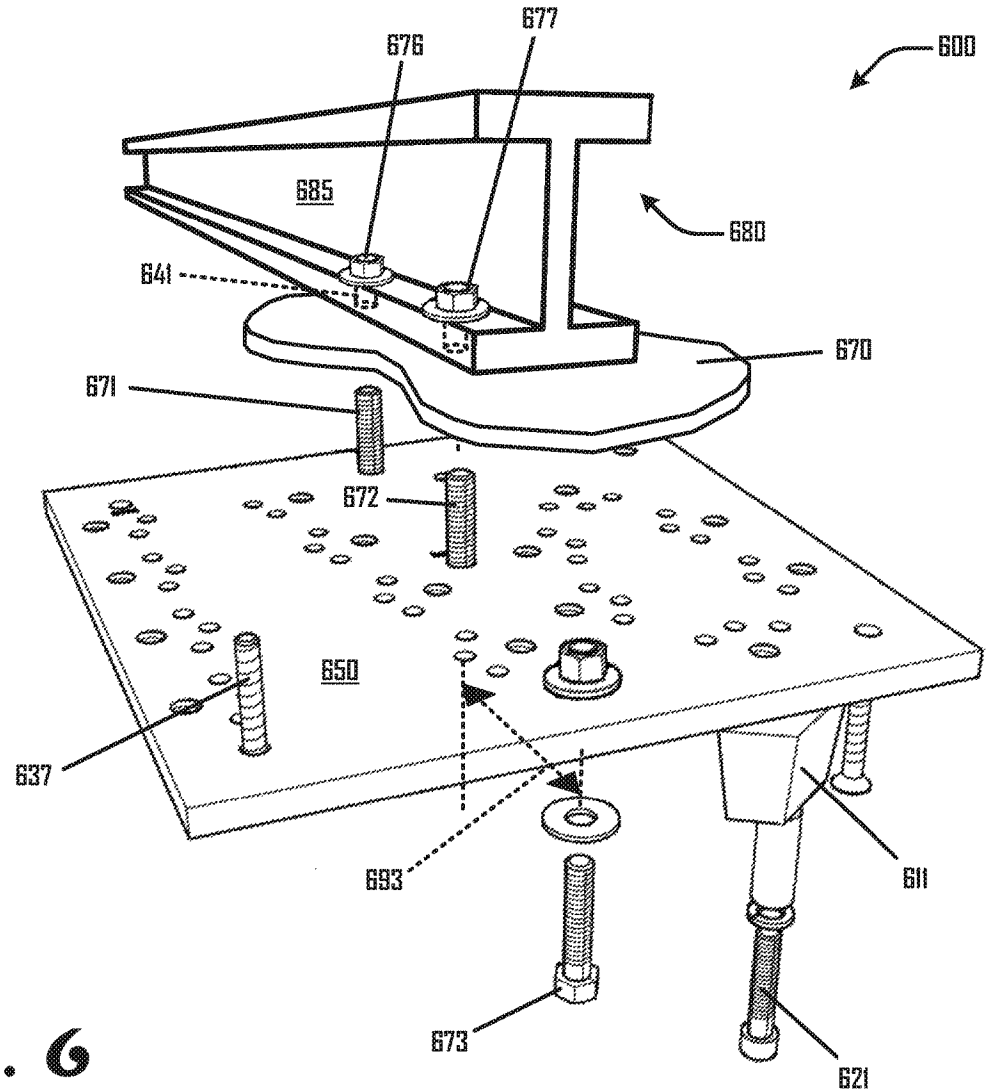
FIG. 6 illustrates a partly exploded view of a climbing facilitation system, optionally exemplifying the system of FIG. 5.

FIG. 6 depicts a partly exploded view of a climbing facilitation system 600, optionally exemplifying system 500. As shown a rigid baseplate 650 is configured as an extension of a superstructure 680 (comprising a beam 685 or other major load bearing structure of a building, e.g.). A primary bolt 672 passes through an unthreaded hole of baseplate 650 and through an unthreaded hole of a flange of beam 685 and then into a respective washer and nut 677 as shown. In this configuration, a substantial downward and/or lateral load borne by a rock 611 (mounted to baseplate 650 with a bolt 621 engaging a threaded hole 146 thereof, e.g.) may exert a substantial torque about the closest major mounting to the beam 685, the fulcrum at bolt 672. See FIG. 1. A lateral load away from bolt 672 will not generally present a problem in this case, even if it is large (more than 10 kN, e.g.). But a substantial circumferential force upon rock 611 (of more than 5 kN, e.g.) will tend to rotate baseplate 650 about bolt 672. This would damage veneer 670 (insofar that neither bolt 673 nor screw 637 engage superstructure 680) but for bolt 671 passing through an unthreaded hole of baseplate 650 and through an unthreaded hole 641 of beam 685 as shown, and then into a respective washer and nut 676. Where feasible it is desirable that an offset 693 (axis-to-axis as shown) between a piece of protection (a redundant anchor 382, 582 at bolt 673, e.g.) and a corresponding fulcrum (bolt 672, e.g.) be less than 20 cm, and more desirable that such offset 693 be less than 15 cm.

Figure 7:
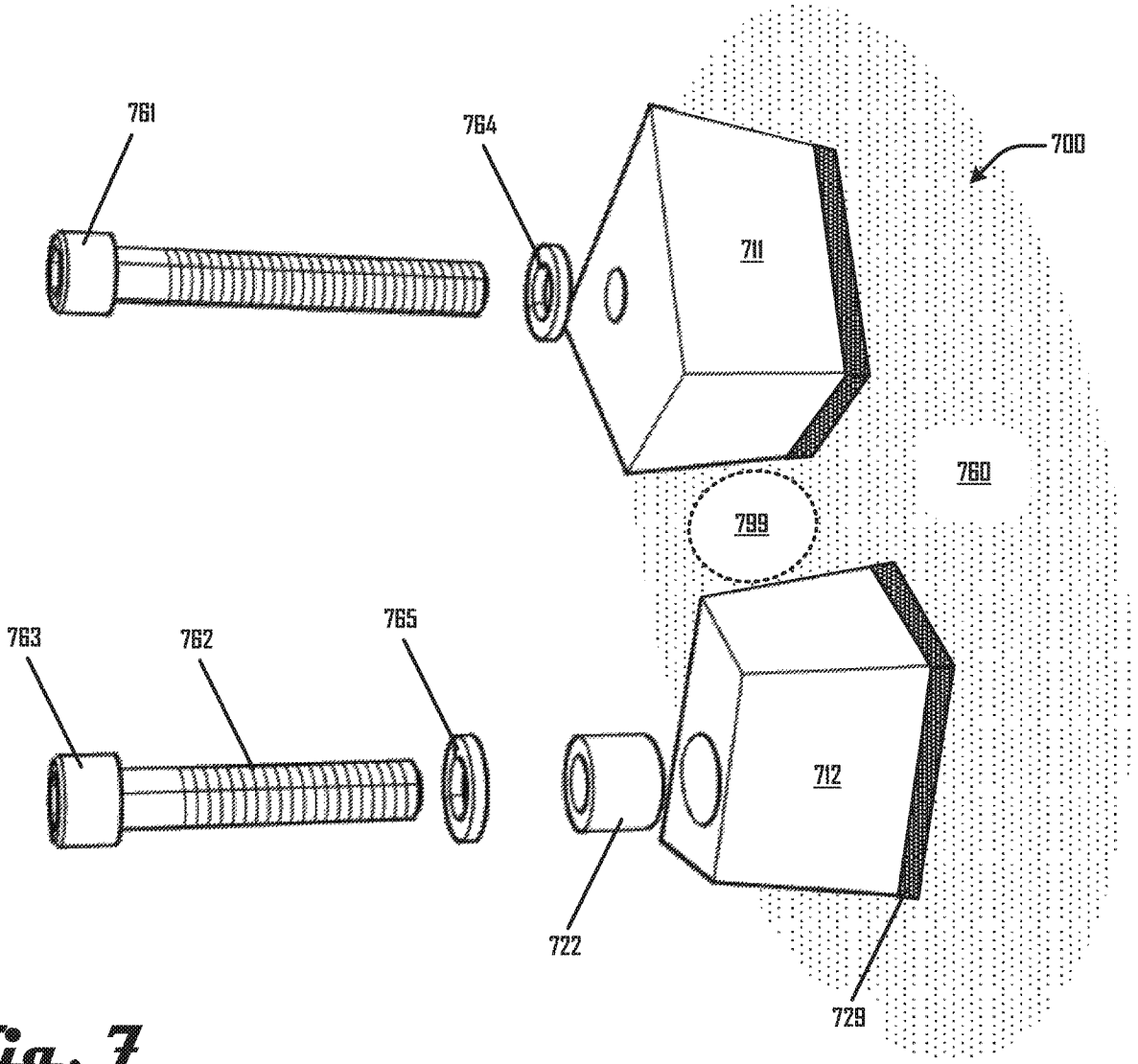
FIG. 7 illustrates a partly exploded view of a climbing facilitation system, optionally exemplifying the system of FIG. 2.

FIG. 7 depicts a partly exploded view of a climbing facilitation system 700, optionally exemplifying system 200. As shown a substrate 760 (a removable, mountable baseplate 250 or load-bearing purposebuilt wall panel comprising a fragile veneer 270, e.g.) has several highly reliable bolt holes with which bolts 761, 762 can engage as shown. As system 700 is assembled, rock 711 is supported (at a "reference position" as shown, e.g.) by bolt 761 passing through washer 765 and into substrate 760. As shown rock 712 (at a "first" position relative to the reference position) is supported by a shorter bolt 762 passing through a washer 765, through a viscoelastic sleeve 722 formed inside rock 712, and then into the substrate 760. This can occur, for example, in a context in which washer 765 is a split washer friction-fit into rock 712; in which a cylindrical stopper is then inserted into one side thereof; in which an elastomeric cylinder is then formed by pouring it into the other side thereof (polyurethane in a melted or uncured state, e.g.) and then allowing it to harden; and in which the elastomeric cylinder is then formed into sleeve 722 by drilling a bore therethrough. In use this can permit rock 712 to have a sunken washer 765 therein configured to engage a head 763 of bolt 762 directly, the sleeve 722 serving as an elastomeric mechanical isolation effectively separating a rigid portion of rock 712 and the sunken washer 765 therein. This can occur, for example, in a context in which the sunken washer 765 is configured to engage a head of bolt 762 directly and in which an elastomeric sleeve 722 mechanically separates a rigid body of rock 712 and the sunken washer 765 therein. This can reduce snagging and injuries by minimizing accidental engagement (of a climber 540 or equipment, e.g.) with the head 763 of bolt 762 as well as mitigate overtightening of the main rock bolt 762, which could otherwise shatter rock 712 by virtue of extremely localized stresses in the immediately surrounding area. In some variants, for example, rock 712 may primarily comprise limestone or some other material (being a majority of rock 712 by weight, e.g.) having a hardness less than 20 kilograms per square millimeter on the Vickers scale; in which such soft varieties of stone are needed for training or certifying novice climbers in the use of traditional protection, and in which such a soft material would not be feasible without sleeve 722 or layer 729 being made of suitable elastomeric materials (hard rubber, e.g.).

Alternatively or additionally, a layer 729 of dark-colored viscoelastic material (on the order of 1 mm or 1 cm thick, e.g.) may be formed on a flat side of each of rocks 711, 712 as shown, to mitigate localized stresses on rocks 711, 712 (caused by overtightening or climber falls, e.g.). A gap 799 is thereby formed so that a suitable traditional protection anchor (a cam, e.g.) may be placed between the rocks 711, 712 and compressed so as to establish a force transfer path sufficient to transfer a falling climber force pulse (larger than 5 kilonewtons, e.g.) upon the anchor without climbing wall breakage by virtue of passing entirely through the bolts 761, 762 into a substructure (and not at all through a fragile veneer of substrate 760, e.g.).

Figure 8:
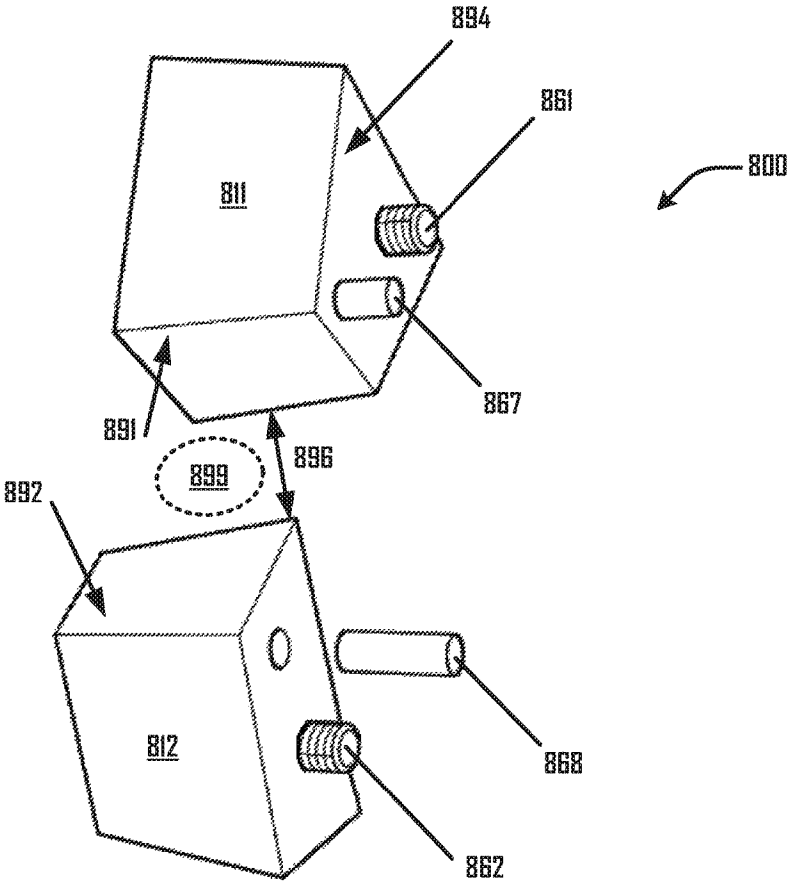
FIG. 8 illustrates a partly exploded view of a climbing facilitation system, optionally exemplifying the system of FIG. 2 or of FIG. 7.

FIG. 8 depicts a climbing facilitation system 800 that may, in some variants, exemplify one or more other systems described herein. System 800 includes a first rigid support (including bolt 861, e.g.) configured to engage a first bolt hole in a primary substructure and a first protrusion (including rock 811, e.g.) configured to be supported at a reference position and by said first rigid support as shown. System 800 likewise includes a second rigid support (including bolt 862, e.g.) configured to engage a second bolt hole in the primary substructure and a second protrusion (including rock 812, e.g.) configured to be supported at a first position relative to said reference position and by said second rigid support. Said first and second protrusions are configured to compress a first traditional protection anchor (a wire nut or hex chock, e.g.) simultaneously from generally opposite sides (in the gap 899 generally between surfaces 891, 892 of the respective protrusions, e.g.) so that a substantial force transfer path upon the first traditional protection anchor is shared by the rigid supports and passes entirely therethrough into the primary substructure, whereby climbing wall breakage is avoided. As used herein, a force transfer path is "substantial" if it is sufficiently robust to transfer a force pulse larger than 5 kilonewtons into a major structure (beam 685, e.g.). As shown, gap 896 has a minimum width 896 large enough to receive such a protection anchor (of more than 1 mm and in some instances more than 1 cm, e.g.). Alternatively or additionally, gap 895 may (optionally) be small enough that a single piece of protection can span the surfaces 891, 892 (being less than 20 centimeters and in some instances less than 12 centimeters, e.g.).

In some variants, system 800 further includes a removable mountable baseplate 250 with threaded holes configured to be directly engaged by respective bolts 861, 862 as shown. Alternatively or additionally, baseplate 250 may include unthreaded holes configured to be directly engaged by respective steel anti-rotation pins 867, 868 so that the above-described force pulse does not cause any discernable rotation of rocks 811, 812 when a climber 540 supported by the first traditional protection anchor falls. Alternatively or additionally, some or all of such protrusions primarily comprise (as a majority by weight percent, e.g.) a material having a hardness greater than 20 kilograms per square millimeter on the Vickers scale (like common granite or steel, e.g.). Moreover in some variants, some or all of such hard protrusions may have an elastomeric layer (thinner than a centimeter and colored approximately to match the harder body thereof, e.g.) on a flat surface 894 thereof (configured to engage a flat metal baseplate, e.g.).

Figure 9:
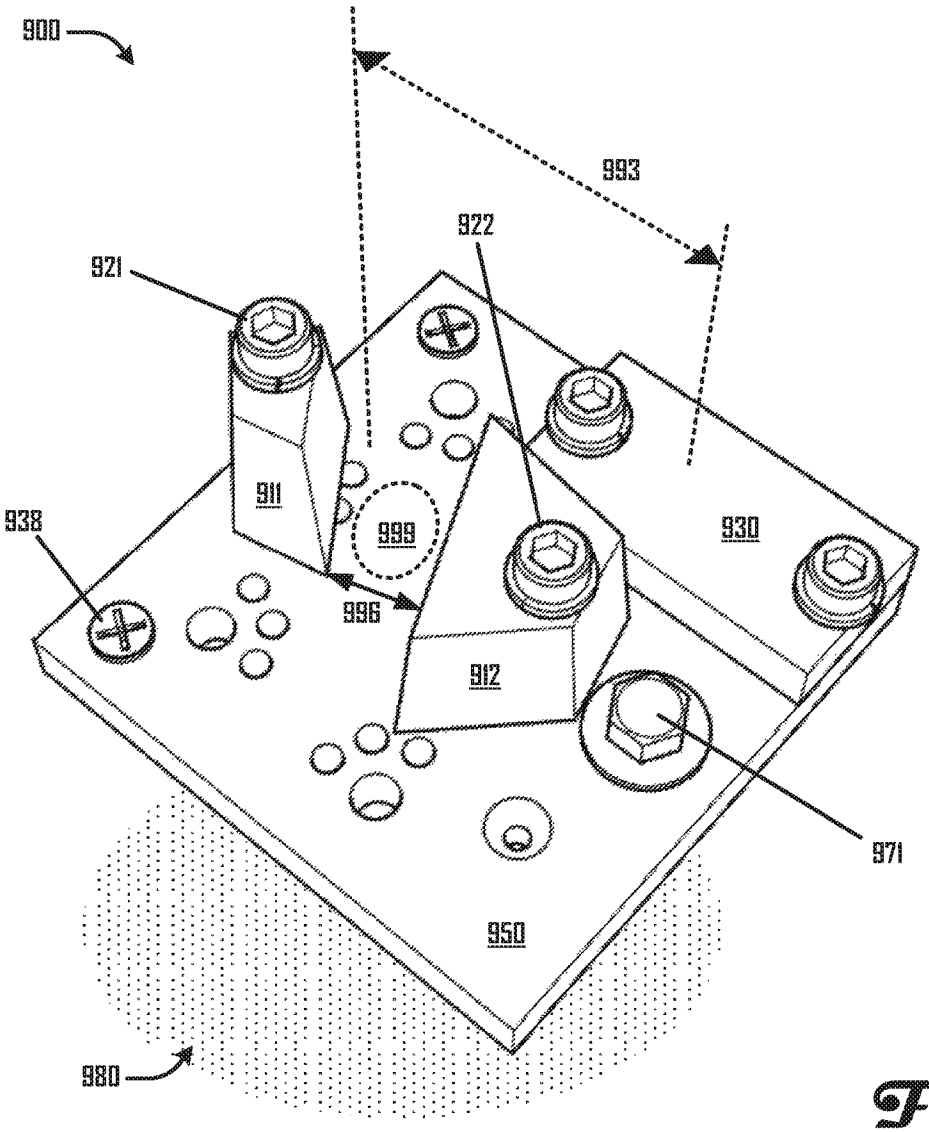
FIG. 9 illustrates a perspective view of the front of an alternate implementation of a completely assembled climbing facilitation system.

FIG. 9 depicts a perspective view of the front of an alternate implementation of a completely assembled climbing facilitation system 900, one that optionally exemplifies system 800. As shown a substructure 980 includes one or more baseplates 150, 250, 550, 650, 950 each include a compact baseplate 950 (having a footprint smaller than 500 square centimeters in area, e.g.) having one or more bolts 971 mounting the baseplate 950 onto a remainder of the substructure 980. In some variants bolt 971 also directly engages a redundant anchor 382, 582 as shown above. System 900 comprises a first bolt 921 configured to engage a first bolt hole 143 in the depicted baseplate 950 of the primary substructure. Rock 911 is configured to be supported at a reference position as shown and by said first bolt 921 that engages the primary substructure 980. Rock 912 is configured to be supported at a first position as shown relative to said reference position and by said second bolt 922 configured to engage (a bolt hole in) the primary substructure 980. At least these protrusions are configured to compress a first traditional protection anchor (to be placed by climber 540 into a gap 999 having a minimum width 996, e.g.) simultaneously so that a substantial force transfer path (sufficient to transfer a force pulse larger than 5 kN) upon the first traditional protection anchor is shared by a first plurality of rigid supports and passes entirely therethrough into baseplate, the first plurality of rigid supports including the first and second bolts 921, 922. In some contexts because the effective offset 993 from the fulcrum of baseplate 950 (i.e. at bolt 971) to an effective point of leverage (between rock 911 and rock 912) that exerts a torque from a falling climber 540 is less than 15 cm, even a worst-case torque (more than 10 kN circumferentially applied, e.g.) is adequately resisted by one or more screws 938 (into a wood panel or other veneer, e.g.). In other contexts such torque is adequately resisted by one or more other bolts 921, 922 extending through baseplate 950 into other portions of substructure 980. Alternatively or additionally, one or more such protrusions on baseplate 950 may each primarily comprise a material having a hardness less than 200 kilograms per square millimeter on the Vickers scale (like sandstone or aluminum, e.g.).

Figure 10:
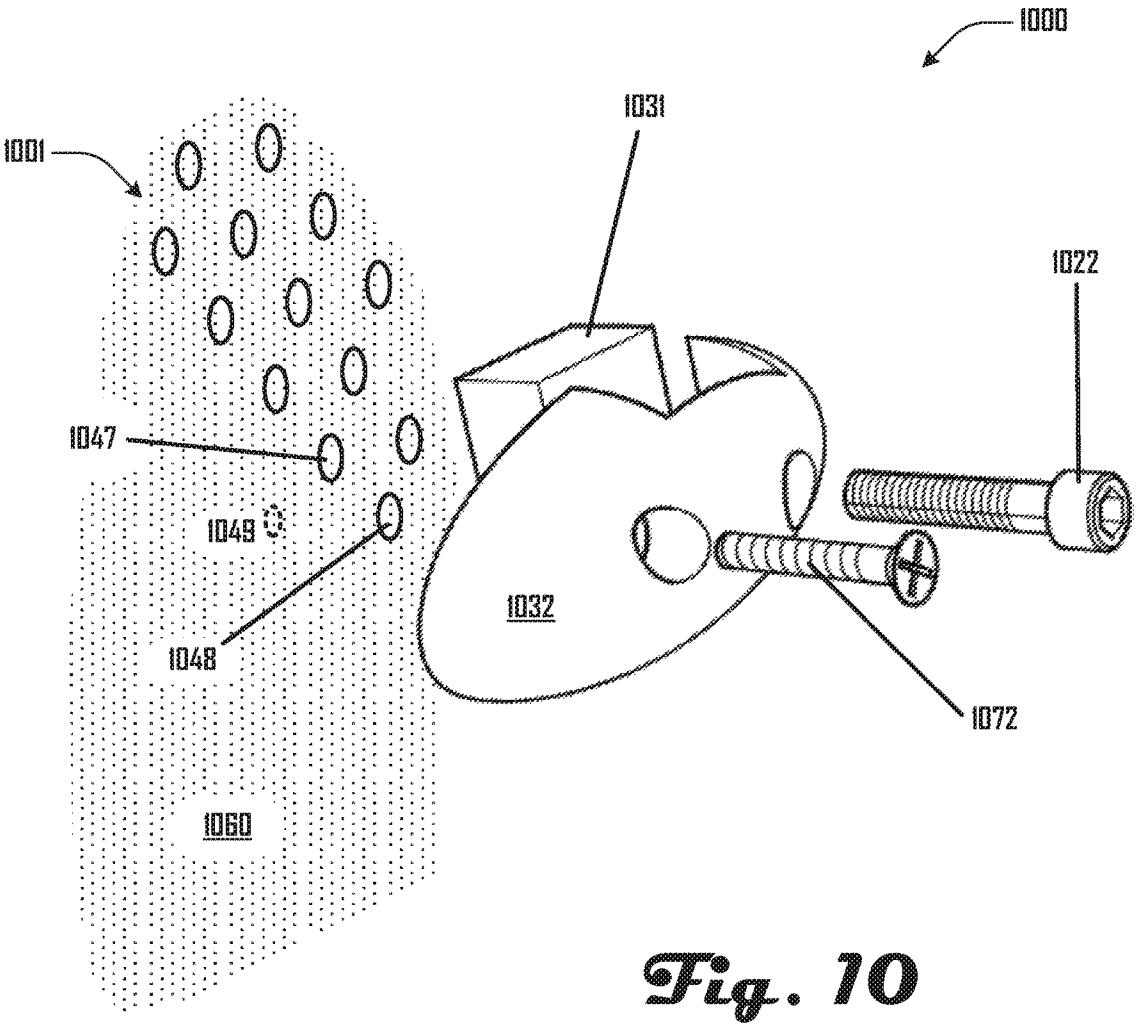
FIG. 10 illustrates a perspective exploded view of components of a protrusion suitable for use in various systems, including one with an array of mounting holes.

FIG. 10 depicts a perspective exploded view of components 1031, 1032 of a protrusion suitable for use in one or more systems 100, 200, 600, 700, 800 as described above. A substrate 1060 as shown includes an array 1001 of many bolt holes 1047, 1048 in a load-bearing substructure 280, 980. (As used herein, "many" refers to more than a dozen.) Bolt 1022 is configured to pass through a plurality of components 1031, 1032 and at least into a particular one of the bolt holes 1047. Screw 1072 passes through at least one of the components 1032 and into a hole 1049 in substrate 1060 but need not engage the load-bearing structure insofar that its purpose (resisting rotation during a climber fall) is adequately served even if it only engages a veneer 270, 670. See FIG. 11.

Figure 11:
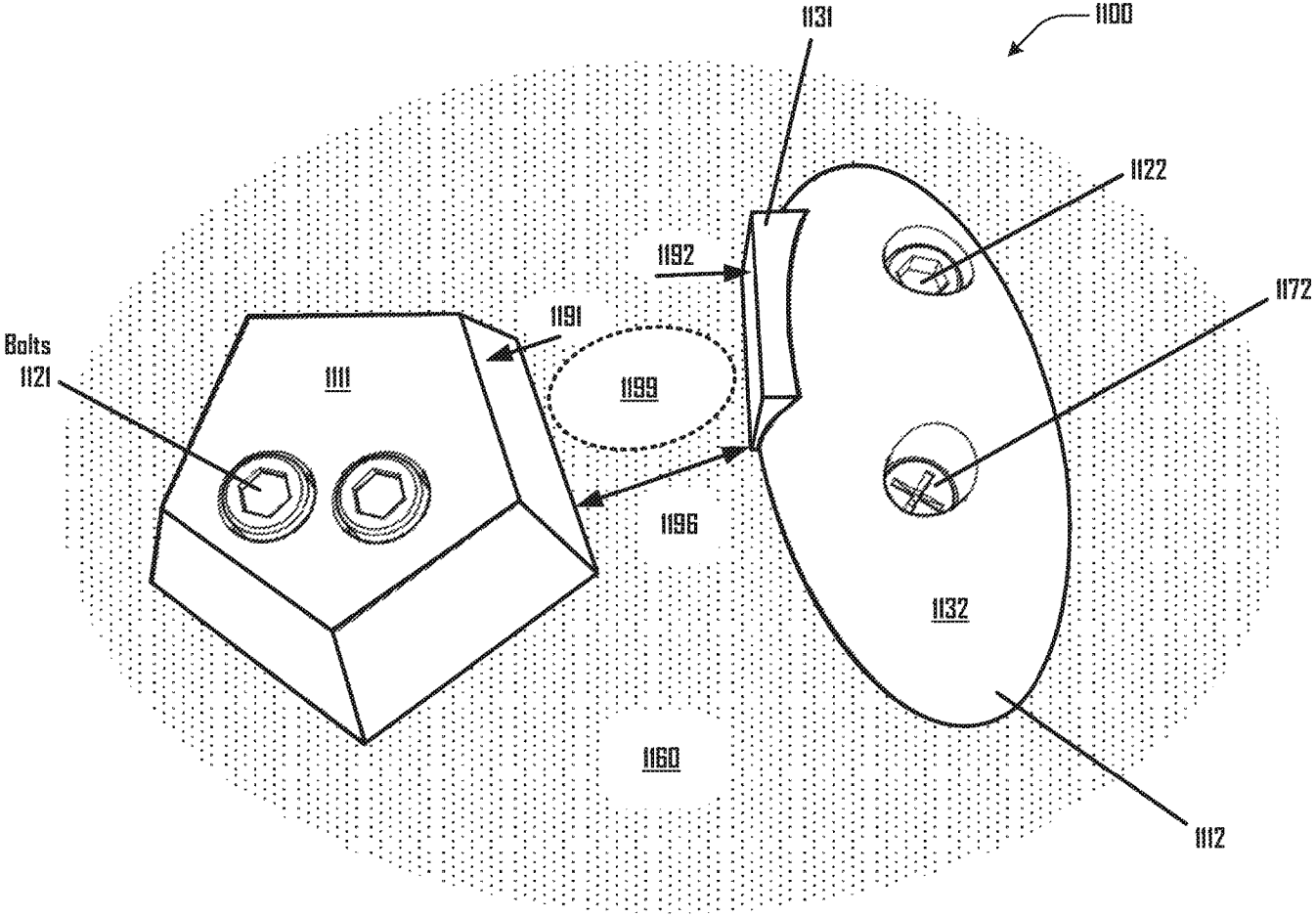
FIG. 11 illustrates a perspective view of the front of an assembled anchor-setting device of a climbing facilitation system formed on a substrate like that of FIG. 10.

FIG. 11 depicts a perspective view of the front of an assembled anchor-setting device of a climbing facilitation system 1100 formed on a substrate 1160 like that of FIG. 10. System 1100 includes a pair of bolts 1121 configured to support a first protrusion 1111 at a reference position by engaging neighboring bolt holes in a primary substructure (of the array 1001 depicted in FIG. 10, e.g.). Bolt 1122 passes through a plurality of components 1131, 1132 of a second protrusion 1112 primarily supported by a bolt 1122 passing into a particular bolt hole 1047. This may occur, for example, in a context in which bolt hole 1047 is threaded or in which bolt 1122 engages a nut after passing through bolt hole 1047. Screw 1172 likewise passes through at least one of the components 1032 of protrusion 1112 and into a hole 1049 having sufficient structure to resist rotation during a climber fall (without damaging a veneer of substrate 1160, e.g.). This positioning of said second protrusion 1112 relative to said first protrusion 1111 positions respective anchor engagement surfaces 1191, 1192 thereof (as intended by a climbing instructor or other route setter, e.g.) to create a gap 1199 having a width 1196 suitable for effective instruction in the use of traditional protection (in a climbing gym or other indoor setting, e.g.). This can occur, for example, in a context in which such protrusions is each a hybrid protrusion, one that combines a hand or foot hold suitable for use by climbers 540 as well as suitable surfaces 1191, 1192 for traditional protection, even in a context in which substrate 1160 does not include a baseplate. Or in another variant, a wall panel could be retrofitted using over-sized custom built washers (10 cm or more in diameter, e.g.) that thru-bolts 1121 are bolted into. Or a baseplate 150 as depicted herein can be replaced with an entire panel (of more than 1000 square centimeters, e.g.) designed to act as a baseplate for rocks and holds (having one or more arrays 1001 of bolt holes, e.g.).

In some variants the first hybrid protrusion 1111 primarily comprises a solid metal or rock configured so that every radially-outward-facing surface 1191 thereof (i.e. all five, in the example as shown) face is suitable for use as a protection-holding surface. Alternatively or additionally, protrusion 1112 may be configured as a first component 1131 featuring a protection-holding surface formed of metal, ceramic or rock and a second component 1132 primarily comprising a poured urethane. As used herein a component or surface "primarily" comprises a material if that material forms a majority of the component by weight or surface area, respectively. Likewise a component or surface "substantially comprises" a material if that material forms more than 30% of the component by weight or surface area.

Figure 12:
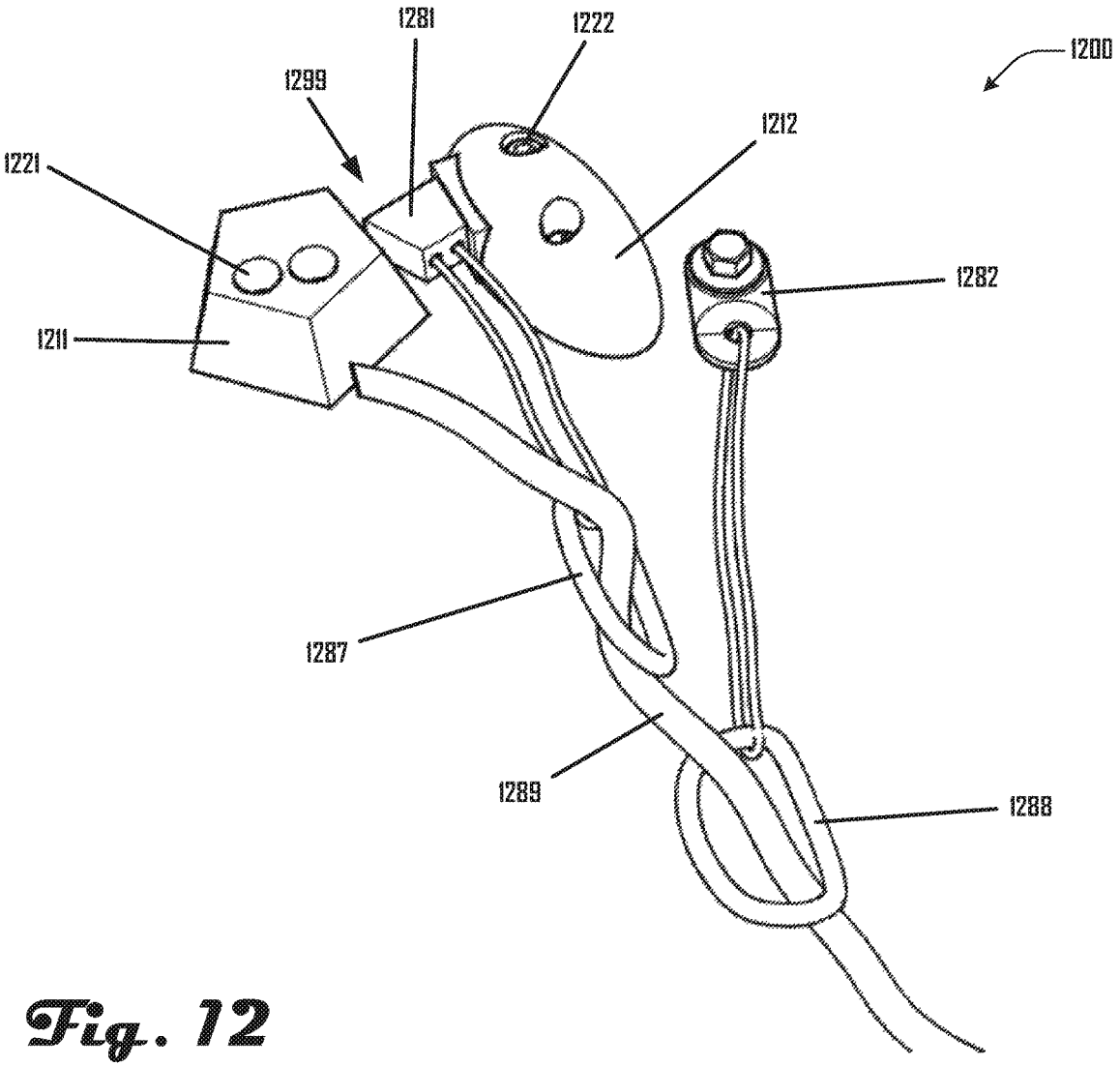
FIG. 12 illustrates a perspective view of a climbing facilitation system like those depicted above, suitable for use with both traditional protection and a primary substructure of a climbing wall.

FIG. 12 depicts a perspective view of a climbing facilitation system 1200 like those depicted above, suitable for use with both traditional protection (including anchor 1281, e.g.) and a primary substructure 280, 980 of a climbing wall (including a substrate 760, 1060, 1160 or superstructure 680, e.g.). At least a first bolt 1221 is configured to engage a first bolt hole (in array 1001, e.g.) in the primary substructure and to support a first protrusion 1211 at a reference position. Likewise at least a second bolt 1222 is configured to engage a second bolt hole 1047 (in the same array 1001 of holes, e.g.) in the primary substructure and to support a second protrusion 1212 at a first position relative to the position of said first protrusion 1211. The protrusions are thus configured to compress a first traditional protection anchor 1281 (placed into gap 1299 by a student climber 540, e.g.) simultaneously so that a first force transfer path passes entirely through protrusions 1211, 1212 and bolts 1221, 1222 without climbing wall breakage, even if traversed by a force pulse larger than 10 kilonewtons. (Such magnitudes may occur, for example, in a survivable leader fall if the traditional protection holds.) FIG. 12 also depicts a properly-placed redundant protection anchor 1282 and carabiners 1287, 1288 clipped onto a rope 1289 of the climber 540.

Figure 13:
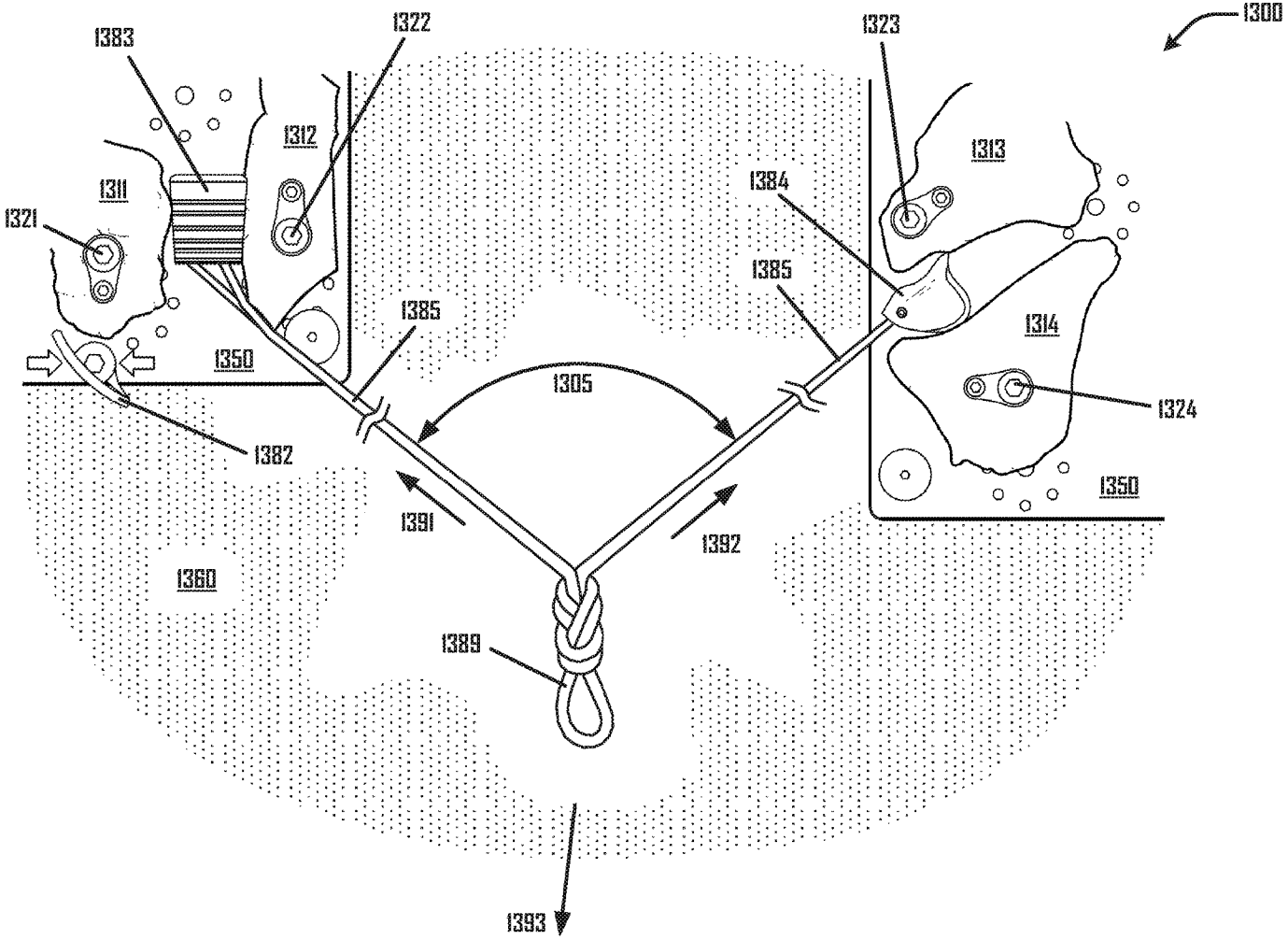
FIG. 13 illustrates a front view of a climbing wall configuration system using a plurality of baseplates.

FIG. 13 depicts a perspective view of a climbing facilitation system 1300 that may include one or more technologies of the present invention. In this context the primary substructure is a climbing wall that includes a substrate 1360 that supports a plurality of baseplates 1350. This provides an example of diagonal loading that might occur in a traditional protection learning context (with a novice climber, e.g.). At least a first bolt 1321 properly supports a first rock 1311 in a first bolt hole in the primary substructure so that rock 1311 is held firmly at a "reference" position. Likewise a second bolt 1322 properly supports a second rock 1312 in a second bolt hole in the primary substructure so that rock 1312 is held firmly at a "first" position. Likewise a third bolt 1323 properly supports a third rock 1313 in a third bolt hole in the primary substructure so that rock 1313 is held firmly at a "second" position. And also a fourth bolt 1324 properly supports a fourth rock 1314 in a fourth bolt hole in the primary substructure so that rock 1314 is held firmly at a "third" position. Rocks 1313, 1314 are held in these relative positions so that a traditional protection anchor 1384 engages both simultaneously as shown. This provides a force transfer path sufficient to transfer a large anticipated force pulse 1392 upon anchor 1384 without any climbing wall breakage. Likewise rocks 1311, 1312 are held in these relative positions so that another traditional protection anchor 1383 engages both simultaneously as shown. This provides a force transfer path sufficient to transfer a large anticipated force pulse 1391 upon anchor 1383 without any climbing wall breakage. One or more ropes 1389 and tethers 1385 of these traditional protection components effectively couple these traditional protection anchors 1383, 1384 into one assembly (a poorly-configured V-angle) as shown, potentially spanning more than a meter between the respective anchors 1383, 1384 as shown.

Those skilled in the art will appreciate that one or both such large component force pulses 1391, 1392 (each potentially exceeding 10 kN, e.g.) may result from a survivable falling climber force pulse 1393 of 10 kN (from climber 540 reaching a lowest extent of rope 1389 with significant downward momentum, e.g.). One thing that makes this configuration "poor" is the large angle 1305 between the legs of the V-angle. The leverage resulting from such large angles (over 90 degrees, e.g.) can amplify the falling climber force pulse 1393 by 50% or more, as shown, so that the sum of the magnitudes of the anticipated component force pulses 1391, 1392 will apparently be much greater than an initial force pulse 1393 that might cause them. Likewise any actual component force pulse 1391 will cause a spreading force upon rocks 1311, 1312 and force pulse 1392 will likewise cause a spreading force upon rocks 1313, 1314. These spreading forces might be excessive, triggering breakage of one or more of the rocks 1311-1314—and perhaps an attendant fall—that could have been avoided if other forms or configurations of protection had been selected. This can occur, for example, in a context in which a student climber does not accurately contemplate the angle or magnitude of force pulses that such anchors 1383, 1384 may bear, especially in more complex assemblies or where soft rocks are engaged (less than 20 kg/mm^2 on the Vickers scale, e.g.). For at least these reasons it is desirable that a climber 540 engage a redundant protection anchor 1382 before the selection and placement of the traditional protection anchors 1383, 1384 and the linkages that connect them.

Figure 14:
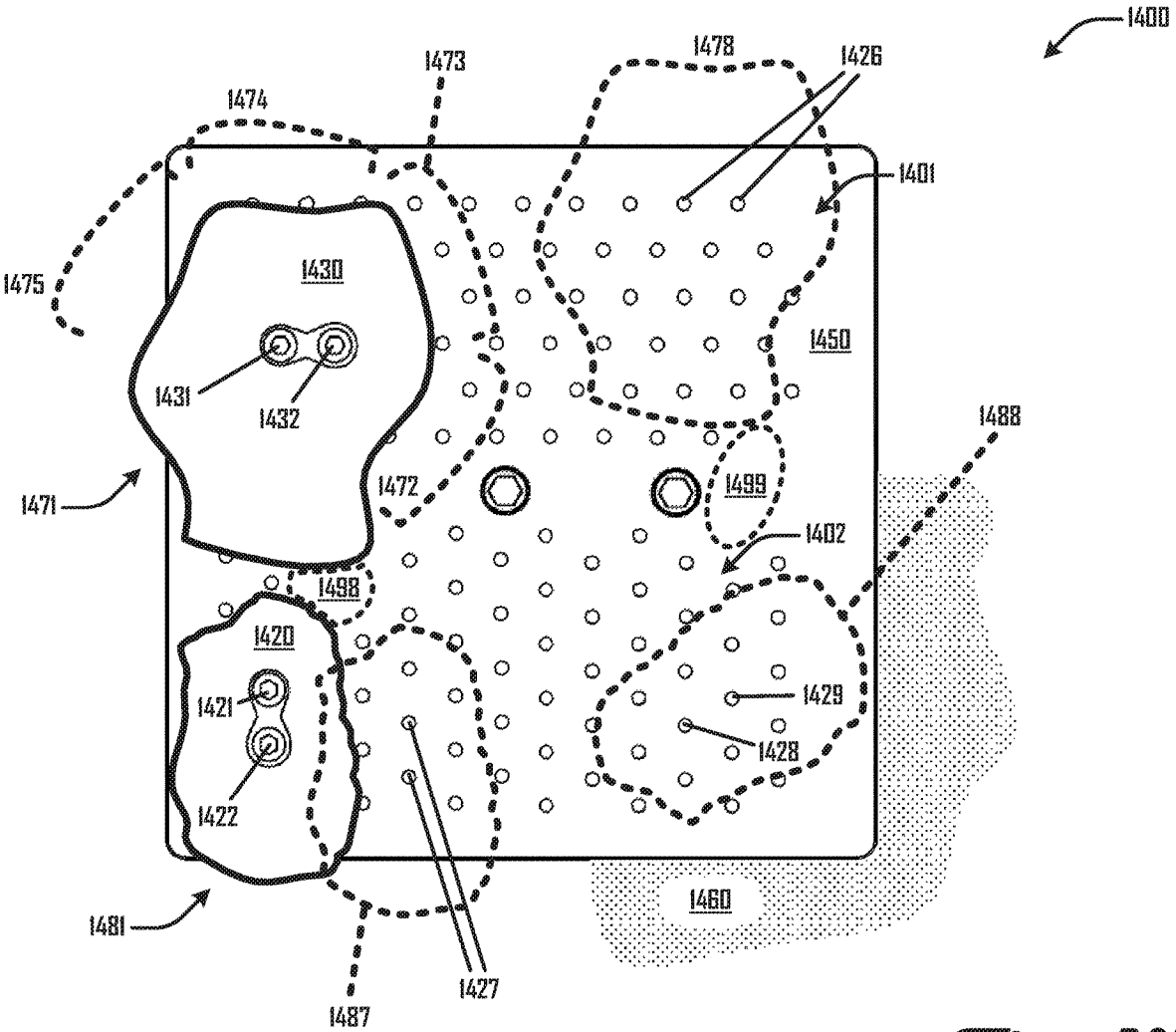
FIG. 14 illustrates a front view of an advanced climbing wall configuration system using a plurality of lattices of mounting holes.

FIG. 14 depicts a front view of a climbing facilitation system 1400 suitable for use with both traditional protection and a primary substructure of a climbing wall that may include one or more technologies of the present invention. In this context the primary substructure is a climbing superstructure having a plurality of walls of which at least one substrate 1460 supports one or more baseplates 1450 as shown. Baseplate 1450 includes many bolt holes 1426 nominally arranged in a first equilateral triangular lattice 1401 and also many bolt holes 1427, 1428, 1429 nominally arranged in a second equilateral triangular lattice 1402. The lattice density and hole sizes are optionally uniform, and some or all of the in-lattice holes may (optionally) be threaded.

System 1400 is configured as shown in an original state, but can be reconfigured in a great variety of ways even without moving baseplate 1450 relative to substrate 1460, examples of which follow. The original state features a pair of bolts 1431, 1432 holding protrusion 1430 in its original position 1471 and another pair of bolts 1421, 1422 holding another protrusion 1420 in its original position 1481, creating a gap 1498 therebetween less than 1 centimeter wide, suitable for small pieces of traditional protection.

One way for a climber 540 to widen gap 1498 is to temporarily remove bolt 1432 and rotate protrusion 1430 (counterclockwise by about 60°, e.g.) to position 1472 (or to any of several other positions 1473, 1474, 1475 relative to the position 1481 of the other protrusion 1420. This can occur, for example, in a context in which a gym worker who is repositioning a heavy protrusion 1430 would otherwise have to remove and lift it into a new position 1473 while poised many meters above the floor of a climbing gym, anytime a positional adjustment is needed. Another way to widen gap 1498 is for climber 540 to temporarily remove bolts 1421, 1422 and slide protrusion 1420 to another position 1487 farther from protrusion 1430 effectively by translation, without any net rotation of said protrusion 1430. Another way to widen gap 1498 is to do both. Any of these transitions can occur, for example, in a context in which reproducing or standardizing diverse challenges and exercises by assembling nominally identical complex protrusions in relative positions (for a multi-region competition or certification, e.g.) would otherwise require that each participating facility inventory very numerous special-purpose pieces.

In another variant system 1400 may include a first rigid support (bolt 1421, e.g.) configured to engage a first bolt hole (hole 1428, e.g.) in the primary substructure and a protrusion 1420 configured to be supported at a reference position 1488 and by the first rigid support. System 1400 further includes a second rigid support (bolt 1432, e.g.) configured to engage a second bolt hole (hole 1426, e.g.) in the primary substructure and a protrusion 1430 configured to be supported at a first position 1478 relative to reference position 1488, with at least these protrusions 1420, 1430 configured to compress a first traditional protection anchor (in gap 1499, e.g.) simultaneously so that a first force transfer path sufficient to transfer a force pulse larger than 5 kilonewtons upon the first traditional protection anchor without climbing wall breakage is shared by a first plurality of rigid supports and passes entirely therethrough into the primary substructure, the first plurality of rigid supports including the first and second rigid supports.

In some variants system 1400 may include many instances of type "A" nominally-identical protrusions 1420, many instances of "type B" nominally-identical protrusions 1430, and many nominally identical baseplates 1450. This can occur, for example, in a context in which one or more of the protrusions is manufactured by injection-molding or other high-precision mass production protocols and in which reproducing or standardizing diverse challenges and exercises by assembling nominally identical complex protrusions in relative positions (for a multi-region competition or certification, e.g.) would otherwise require that each participating facility inventory very numerous special-purpose pieces.

In another context system 1400 may include a baseplate 1450 having a first grouping of many holes arranged in a first equilateral triangular lattice 1401 (having horizontal rows as depicted, e.g.), the baseplate also having a second grouping of many holes arranged in a second equilateral triangular lattice 1402 inconsistent with the first lattice, several of the many holes arranged in the second equilateral triangular lattice being offset from any rows of the first equilateral triangular lattice. This can occur, for example, in a context in which protrusion 1420 could otherwise only be mounted in a few hundred positions relative to protrusion 1430 (limiting the possible permutations by virtue of both protrusions having to resolve into the same equilateral triangular lattice, e.g.) or in which an arrangement of two protrusions 1420, 1430 could otherwise only be co-rotated in whole increments larger than 45°.

Figure 15:
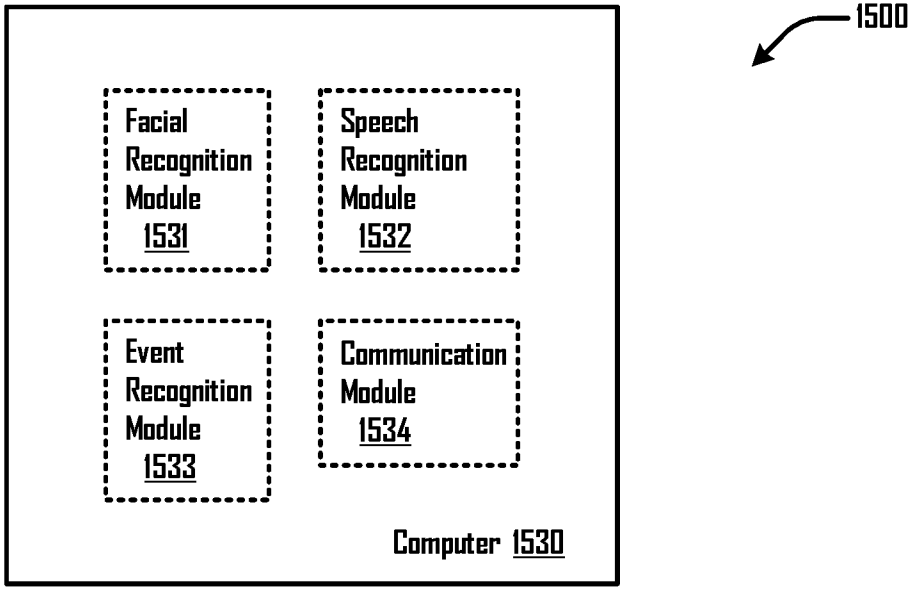
FIG. 15 illustrates a system that includes a climbing computer.

FIG. 15 depicts schematically a system 1500 that may exemplify variants of other systems 100, 500, 900 above that feature electronics (such as one or more climbing computers 130, 930, 1530). Such variants may, in some embodiments, include one or more facial recognition modules 1531 each configured to recognize a particular user (climber 540, e.g.). Alternatively or additionally, such computers 130, 930, 1530 may include one or more communication modules 1534 that communicate (through a smart phone, fitness bracelet worn by the user, or other nearby smart device, e.g.) heuristics about usage (weight, facial recognition, voiceprint) indicative of the user. Alternatively or additionally, detected forces (upon each rock 911, e.g.), component positions, times and types of climber falls, whether protection held, dwell time on a hold, distance traveled per hold, and other such indicia may be detected (directly by one or more event recognition modules 1533 or indirectly through a voice menu implemented via one or more speech recognition modules 1532, e.g.) and communicated by a communication module 1534. The computer intelligence of sensors that monitor the holds (rocks or other protrusions described herein, e.g.) along with smart devices and connection to the web will allow climbers 540 to track their individual progress, to issue challenges, to compete with each other, and to provide ratings of routes and route-setters. Alternatively or additionally, in some variants route setters and other climbers 540 can take pictures of the baseplates (with an app that is paired with the placement of the closest hold based on radio frequency or other electronic identification, e.g.). These pictures can then be shared and seen by climbers or other route-setters.

"About," "any," "arranged," "at," "being," "both," "by," "climbing," "comprising," "configured," "coupled," "covered," "damaged," "directly," "each," "elastomeric," "engaging," "enough," "equilateral," "facing," "first," "flat," "for," "from," "further," "greater," "hard," "having," "horizontal," "identical," "in," "including," "into," "irregular," "jointly," "larger," "least," "like," "long," "manually," "manufactured," "many," "metal," "most," "mounted," "moving," "net," "nominal," "of," "offset," "on," "other," "outward," "partly," "per," "pivoting," "plurality," "primarily," "primary," "radially," "reference," "relative," "remaining," "repositionable," "respective," "rigid," "rock," "rotating," "rough," "said," "second," "selectively," "separated," "several," "shared," "simultaneous," "spreading," "square," "strong," "sufficient," "suitable," "sunken," "supported," "thereof," "thicker," "thinner," "threaded," "through," "to," "traditional," "translating," "triangular," "unthreaded," "upon," "vertical," "wherein," "wider," "with," "without," or other such descriptors herein are used in their normal yes-or-no sense, not as terms of degree, unless context dictates otherwise. In light of the present disclosure those skilled in the art will understand from context what is meant by "a rock," as that term is used herein to identify a discrete item. In some variants such an item may be made of metal or artificial composite materials, even in lieu of granite or other such species of materials containing "rock."

Referring again at least to FIGS. 5, 6, 9-12, and 14, there is shown an aggregated climbing wall configuration system suitable for use with both traditional protection (e.g. one or more of items 584, 1281) and a primary substructure of a climbing wall (e.g. one or more of items 680, 980). The aggregated system comprises a first rigid support (e.g. one or more of items 1121, 1122) configured to engage a first bolt hole (e.g. one or more of items 1047, 1048, 1426-1429) in the primary substructure. The aggregated system further comprises a first protrusion configured to be supported (e.g. one or more of items 1111, 1112) at a reference position (see FIG. 14) and by said first rigid support, engaging said first bolt hole in the primary substructure. The aggregated system further comprises a second rigid support configured to engage a second bolt hole in the primary substructure. The aggregated system further comprises a selectively repositionable second protrusion configured to be supported at a first position relative to said reference position and by said second rigid support, engaging said second bolt hole in the primary substructure, said first and second protrusions configured to compress a first traditional protection anchor jointly so that a first force transfer path is shared by a first plurality of rigid supports and sufficient to transfer a force pulse larger than 10 kilonewtons upon the first traditional protection anchor without climbing wall breakage (of fragile veneer 570, e.g.) into the primary substructure, the first plurality of rigid supports including the first and second rigid supports. The aggregated system further comprises a first baseplate 550 configured to support at least said first and second protrusions, the first traditional protection anchor, a second baseplate 1150 configured to support at least third and fourth protrusions 1111, 1112, a second traditional protection anchor configured to exert a spreading force upon the third and fourth protrusions, and tethering including rope 589 coupled to the first and second traditional protection anchors (protection 584, e.g.) and configured to support a climber 540.

Referring generally to the protocols and structures disclosed herein, in fact they are quite unlike those of U.S. Pub. No. 2015/0056590 and other early efforts to allow for traditional protection on a climbing wall. The particular combinations expressed below matter far more than mere occurrences of design choice haphazardly assembled by a product designer of ordinary skill. Rather, they are actually a unique breakthrough that the inventor hereof is disclosing to the public in exchange for a limited period of rightfully exclusive use thereof, as provided by applicable law.

With respect to the numbered clauses and claims expressed below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

CLAUSES

1. A climbing wall configuration system suitable for use with both traditional protection (e.g. one or more of items 481, 584, 1281, 1383, 1384) and a primary substructure of a climbing wall (e.g. one or more of items 280, 680, 980), the climbing wall configuration system comprising:

a first rigid support (e.g. one or more of items 221-224, 1121, 1122 or other suitably robust structures) configured to engage a first primary hole (e.g. one or more of items 641, 1047, 1048, 1426-1429) in the primary substructure;

a first protrusion configured to be supported (e.g. one or more of items 211-214, 1111, 1112) at a reference position (see FIG. 14) and by said first rigid support, engaging said first primary hole in the primary substructure;

a second rigid support configured to engage a second primary hole in the primary substructure;

a selectively repositionable second protrusion configured to be supported at a first position relative to said reference position (i.e. said second protrusion being repositionable from the first position to another position relative to said reference position without moving the first protrusion) and by said second rigid support, engaging said second primary hole in the primary substructure, said first and second protrusions configured to compress a first traditional protection anchor jointly so that a first force transfer path is shared by a first plurality of rigid supports and sufficient to transfer a (prospective or actual) force pulse larger than 5 kilonewtons (see FIG. 13) upon the first traditional protection anchor without climbing wall breakage into the primary substructure, the first plurality of rigid supports including the first and second rigid supports.

2. The climbing wall configuration system of clause 1, further comprising:

the primary substructure being at least partly covered by a climbing veneer that is not strong enough to bear a 5 kilonewton force (e.g. one or more of items 270, 570, 670) without breakage, whereby the first force transfer path is configured to protect the climbing veneer from being damaged by the force pulse larger than 5 kilonewtons.

3. The climbing wall configuration system of ANY of the above clauses further comprising:

a first baseplate (e.g. one or more of items 150, 250, 350, 550, 650, 950, 1350, 1450) configured to support the first and second protrusions.

4. The climbing wall configuration system of clause 3 further comprising:

the second protrusion having been repositioned to the first position (e.g. one or more of items 1478, 1487) from a prior first position thereof (e.g. one or more of items 1471, 1481) on said first baseplate without any net rotation of said second protrusion.

5. The climbing wall configuration system of clause 3 further comprising:

said first baseplate having a first grouping of many threaded holes arranged in a lattice (one or more of items 1001, 1401, e.g.), the first baseplate being a component of the primary substructure, at least two of the many threaded holes being the first and second primary holes.

6. The climbing wall configuration system of clause 3 further comprising:

said first baseplate, having a first grouping of many holes arranged in a first equilateral triangular lattice (item 1401 having nominally horizontal rows, e.g.), said first baseplate also having a second grouping of many holes arranged in a second equilateral triangular lattice (item 1402 having nominally vertical rows as depicted, e.g.), several of the many holes arranged in the second equilateral triangular lattice being offset from any rows of the first equilateral triangular lattice.

7. The climbing wall configuration system of clause 3 further comprising:

said first baseplate, configured to support at least said first and second protrusions (e.g. one or more of items 1311-1312);

the first traditional protection anchor (item 1383, e.g.);

a second baseplate configured to support at least third and fourth protrusions (e.g. one or more of items 1313-1314);

a second traditional protection anchor (item 1384, e.g.) configured to exert a spreading force upon the third and fourth protrusions; and tethering (including rope 1389, e.g.) coupled to the first and second traditional protection anchors and configured to support a climber.

8. The climbing wall configuration system of clause 3 further comprising:

said first and second rigid supports (e.g. one or more of items 211-214, 611, 711-712, 811-812, 1111) each having an elastomeric layer (item 729, e.g.) thinner than a centimeter on a surface thereof that is configured to engage a flat metal baseplate, the flat metal baseplate being said first baseplate.

9. The climbing wall configuration system of clause 3 further comprising:

the second rigid support including a bolt configured to pass into said first baseplate, said first baseplate having an unthreaded hole, the second rigid support being long enough to extend out of the second protrusion and through the unthreaded hole and to engage a nut (see FIG. 6).

10. The climbing wall configuration system of clause 3 further comprising:

the first rigid support including said first baseplate having a threaded hole and a bolt configured to extend out of the first protrusion and (having threading configured) to engage the threaded hole of said first baseplate.

11. The climbing wall configuration system of ANY of the above clauses further comprising:

said first rigid support including a first bolt, a first nut, and at least one washer therebetween (see FIG. 6).

12. The climbing wall configuration system of ANY of the above clauses further comprising:

said first protrusion (e.g. one or more of items 211-214, 611, 711-712, 811-812, 1111) wherein said first protrusion primarily comprises limestone (more than 50% by weight, e.g.).

13. The climbing wall configuration system of ANY of the above clauses further comprising:

said second protrusion having been mass produced as one of many nominally identical forms.

14. The climbing wall configuration system of ANY of the above clauses further comprising:

said second protrusion having been manufactured by injection molding.

15. The climbing wall configuration system of ANY of the above clauses further comprising:

said second protrusion (e.g. one or more of items 511-512, 1311-1314, 1420, 1430) having at least one irregular (nominally rough and not flat, e.g.) protection-holding surface.

16. The climbing wall configuration system of ANY of the above clauses further comprising:

said second protrusion (e.g. one or more of items 511-512, 1311-1314, 1420, 1430) wherein said second protrusion primarily comprises granite (more than 50% by weight, e.g.).

17. The climbing wall configuration system of ANY of the above clauses further comprising:

said second protrusion (item 811, e.g.), wherein said second protrusion is configured to receive an anti-rotation pin (item 867, e.g.).

18. The climbing wall configuration system of ANY of the above clauses wherein said second protrusion is repositionable from the first position to another position relative to said reference position by manually pivoting the second protrusion about the second rigid support without moving the first protrusion.

19. The climbing wall configuration system of ANY of the above clauses wherein said second protrusion is repositionable from the first position to another position relative to said reference position by manually translating the second protrusion to another primary hole in the primary substructure without a net rotation of the second protrusion and without moving the first protrusion.

20. The climbing wall configuration system of ANY of the above clauses wherein said first and second protrusions are separated by a gap (item 1499, e.g.) more than 3 centimeters wide as mounted.

21. The climbing wall configuration system of ANY of the above clauses wherein said first and second protrusions are separated by a gap (item 298, e.g.) less than 5 centimeters wide as mounted.

22. The climbing wall configuration system of ANY of the above clauses wherein said first and second protrusions are separated by a gap (item 1498, e.g.) less than 10 centimeters wide as mounted.

23. The climbing wall configuration system of ANY of the above clauses wherein said first protrusion primarily comprises a material (like sandstone or limestone, e.g.) having a hardness less than 20 kilograms per square millimeter (on the Vickers scale).

24. The climbing wall configuration system of ANY of the above clauses wherein said second protrusion primarily comprises (a majority by weight #) a material (like common granite or steel, e.g.) having a hardness greater than 20 kilograms per square millimeter (on the Vickers scale).

25. The climbing wall configuration system of ANY of the above clauses wherein said second protrusion primarily comprises a material (like sandstone or aluminum, e.g.) having a hardness less than 200 kilograms per square millimeter (on the Vickers scale).

26. The climbing wall configuration system of ANY of the above clauses further comprising:

said first protrusion (e.g. one or more of items 211-214, 611, 711-712, 811-812, 1111) featuring several (i.e. at least three and at most ten) radially-outward-facing surfaces each suitable for use as a protection-holding surface.

27. The climbing wall configuration system of ANY of the above clauses further comprising:

said first protrusion having a protection-holding surface (e.g. one or more of items 891, 1191) substantially comprising rock.

28. The climbing wall configuration system of ANY of the above clauses further comprising:

said second protrusion having a protection-holding surface (e.g. one or more of items 891, 1192) substantially comprising metal.

29. The climbing wall configuration system of ANY of the above clauses further comprising:

a first baseplate (e.g. item 950) smaller than 500 square centimeters in area (i.e. footprint).

30. The climbing wall configuration system of ANY of the above clauses further comprising:

a second baseplate (e.g. one or more of items 550, 1350) larger than 1000 square centimeters in area (i.e. footprint).

31. The climbing wall configuration system of ANY of the above clauses further comprising:

a first baseplate configured to support the first and second protrusions, the first baseplate having no screwholes (e.g. item 1450).

32. The climbing wall configuration system of ANY of the above clauses further comprising:

said first protrusion (e.g. one or more of items 1111, 1420, 1430) being supported at the reference position by a first pair of bolts, one of the first pair of bolts being the first rigid support and engaging said first primary hole in the primary substructure, the pair of bolts being offset from one another by less than 3 centimeters.

33. The climbing wall configuration system of ANY of the above clauses further comprising:

said first protrusion having a sunken washer therein (item 765, e.g.) configured to engage a bolt head (item 763, e.g.) of said first rigid support directly, said first protrusion also having an elastomeric structure between a rigid portion thereof and the sunken washer therein.

34. The climbing wall configuration system of ANY of the above clauses further comprising:

said first protrusion being configured to be repositioned to any of several other positions (e.g. one or more of items 1472-1475) by rotating the first protrusion about said first rigid support (e.g. one or more of items 121, 1431) with said first rigid support remaining at least partly engaged with said first primary hole (e.g. item 146) in the primary substructure.

35. The climbing wall configuration system of ANY of the above clauses further comprising:

said second protrusion being supported at the first position by a bolt and by a screw, the second rigid support comprising the bolt and engaging said second primary hole in the primary substructure, the screw not engaging the primary substructure, the screw being offset from the bolt by more than 3 centimeters (see FIG. 10).

With respect to the appended claims below, it will be appreciated by those of ordinary skill in the art that alternate and/or equivalent implementations may be substituted for the specific embodiments shown and described without departing from the scope of the present disclosure. This application is intended to cover any adaptations or variations of the embodiments discussed herein.

The invention claimed is:

1. A climbing wall configuration system for use with spreading-type protection, the climbing wall configuration system comprising:

a climbing wall having a primary substructure and a climbing veneer, wherein the primary substructure is at least partly covered by the climbing veneer and wherein the climbing veneer is not strong enough to bear a 5 kilonewton force without breakage;

a first baseplate extending from the primary substructure, said first baseplate having a first grouping of many threaded holes arranged in rows, the many threaded holes including first and second bolt holes in said first baseplate;

a first metal bolt engaging said first bolt hole in said first baseplate;

a first protrusion supported at a reference position and by said first metal bolt, supported at said first bolt hole in said first baseplate, wherein said first protrusion primarily comprises rock;

a second metal bolt engaging said second bolt hole in said first baseplate;

one or more other metal bolts extending from said first baseplate into the primary substructure; and a selectively repositionable second protrusion supported at a first mounted position relative to said reference position and by said second metal bolt, supported at said second bolt hole in said first baseplate, said first and second protrusions configured to compress a first spreading-type protection anchor jointly so that a first force transfer path is shared between the first and second metal bolts and sufficient to transfer a force pulse larger than 5 kilonewtons upon the first spreading-type protection anchor without breakage to the climbing veneer and into the primary substructure through the one or more other metal bolts, wherein said selectively repositionable second protrusion primarily comprises rock.

2. The climbing wall configuration system of claim 1 wherein said first protrusion primarily comprises limestone.

3. The climbing wall configuration system of claim 1 wherein said first and second protrusions are separated by a gap more than 3 centimeters wide and less than 10 centimeters wide as mounted.

4. A climbing wall configuration system for use with a first spreading-type protection anchor, the climbing wall configuration system comprising:

a climbing wall having a primary substructure and a climbing veneer, wherein the primary substructure is at least partly covered by the climbing veneer and wherein the climbing veneer is not strong enough to bear a 5 kilonewton force without breakage;

a first baseplate with first, second, third, and fourth bolt holes in said first baseplate, wherein said first baseplate extends from the primary substructure and over the climbing veneer;

a first metal bolt;

a first protrusion supported at a reference position at said first baseplate and by said first metal bolt, wherein said first metal bolt engages said first bolt hole in said first baseplate;

a second metal bolt;

a selectively repositionable second protrusion supported at a first mounted position relative to said reference position and by said second metal bolt, wherein said second metal bolt engages said second bolt hole in said first baseplate, wherein said first and second protrusions are configured to compress the first spreading-type protection anchor jointly; and third and fourth metal bolts respectively extending from the third and fourth bolt holes in the first baseplate and into the primary substructure wherein a first force transfer path is shared between said first and second bolts from the first and second protrusions to the first baseplate and is also shared between said third and fourth bolts from the first baseplate to the primary substructure so that a force pulse larger than 5 kilonewtons upon the first spreading-type protection anchor can be shared between the first and second metal bolts and pass into said first baseplate and can also be shared between the third and fourth metal bolts and pass through said third and fourth metal bolts into said primary substructure without any breakage of the climbing veneer.

5. The climbing wall configuration system of claim 4 further comprising:

said first protrusion being configured to be repositioned to any of several other positions by rotating the first protrusion about said first metal bolt with said first metal bolt remaining at least partly engaged with said first bolt hole in said first baseplate.

6. The climbing wall configuration system of claim 4 further comprising:

said first baseplate having a first grouping of many holes arranged in a first equilateral triangular lattice and including said first bolt hole, said first baseplate also having a second grouping of many holes arranged in a second equilateral triangular lattice separate from the first grouping and including said second bolt hole, wherein several of the many holes arranged in the second equilateral triangular lattice are not aligned with any rows of the first equilateral triangular lattice and wherein the third and fourth bolt holes are both separate from the first and second groupings.

7. The climbing wall configuration system of claim 4 further comprising:

said first baseplate supporting at least said first and second protrusions;

a second baseplate supporting at least third and fourth protrusions;

the first spreading-type protection anchor;

a second spreading-type protection anchor configured to exert a spreading force upon the third and fourth protrusions; and tethering coupled between the first and second spreading-type protection anchors and configured to support a climber and to share a load between the first and second spreading-type protection anchors.

8. The climbing wall configuration system of claim 4 further comprising:

said first protrusion having a sunken washer therein configured to engage a bolt head of said first metal bolt directly, said first protrusion also having an elastomeric structure between a rigid portion thereof and the sunken washer therein.

9. The climbing wall configuration system of claim 4 further comprising:

said first and second protrusions each having an elastomeric layer thinner than a centimeter on a surface thereof that is configured to engage a flat metal baseplate, the flat metal baseplate being said first baseplate.

10. The climbing wall configuration system of claim 4 wherein said selectively repositionable second protrusion is repositionable from the first mounted position to another position relative to said reference position by manually pivoting said selectively repositionable second protrusion about the second metal bolt without moving the first protrusion.

11. The climbing wall configuration system of claim 4 wherein said first and second protrusions are separated by a gap less than 5 centimeters wide as mounted.

12. The climbing wall configuration system of claim 4 wherein said first protrusion primarily comprises a material having a hardness less than 20 kilograms per square millimeter (Vickers).

13. The climbing wall configuration system of claim 4 wherein said selectively repositionable second protrusion primarily comprises a material having a hardness greater than 20 kilograms per square millimeter.

14. The climbing wall configuration system of claim 4 wherein said selectively repositionable second protrusion primarily comprises a material having a hardness less than 200 kilograms per square millimeter.

15. The climbing wall configuration system of claim 4 further comprising:

said first and second protrusions each having an elastomeric layer having an order of magnitude of 1 millimeter thick or of 1 centimeter thick on a surface thereof that engages a flat metal baseplate, the flat metal baseplate being said first baseplate.

16. A climbing wall configuration system for use with spreading-type protection, the climbing wall configuration system comprising:

a climbing wall having a primary substructure and a climbing veneer, wherein the primary substructure is at least partly covered by the climbing veneer and wherein the climbing veneer is not strong enough to bear a 5 kilonewton force without breakage;

a first metal bolt engaging a first bolt hole in the primary substructure;

a first protrusion supported at a reference position and by said first metal bolt, supported at said first bolt hole in the primary substructure;

a second metal bolt engaging a second bolt hole in the primary substructure; and a selectively repositionable second protrusion supported at a first mounted position relative to said reference position and by said second metal bolt, supported at said second bolt hole in the primary substructure, said first and second protrusions configured to compress a first spreading-type protection anchor jointly so that a first force transfer path is shared by the first and second metal bolts and sufficient to transfer a force pulse larger than 5 kilonewtons upon the first spreading-type protection anchor without any breakage of the climbing veneer into the primary substructure.

17. The climbing wall configuration system of claim 16 further comprising:

wherein said primary substructure of said climbing wall includes a flat metal baseplate smaller than 500 square centimeters in area in which the first and second bolt holes are formed.

18. The climbing wall configuration system of claim 17, wherein said second protrusion comprises:

a rigid body;

a washer sunken into a recess of said rigid body and rigidly supporting a head of the second metal bolt;

an elastomeric mechanical isolation sleeve that mechanically separates the rigid body and the washer sunken into the recess of said rigid body; and an elastomeric layer on a surface of the rigid body that engages said flat metal baseplate.

19. The climbing wall configuration system of claim 16, wherein said second protrusion comprises:

a rigid body;

a washer sunken into a recess of said rigid body and rigidly supporting a head of the second metal bolt; and an elastomeric mechanical isolation sleeve that mechanically separates the rigid body and the washer sunken into the recess of said rigid body.

20. The climbing wall configuration system of claim 16 further comprising:

said first and second protrusions each having an elastomeric layer on a surface thereof that is configured to engage a flat substrate, wherein said primary substructure includes said flat substrate.

* * * * *